US011786094B2

(12) United States Patent
DeJonge et al.

(10) Patent No.: US 11,786,094 B2
(45) Date of Patent: Oct. 17, 2023

(54) SURFACE CLEANING APPARATUS

(71) Applicant: BISSELL Inc., Grand Rapids, MI (US)

(72) Inventors: Mitchell J. DeJonge, Fruitport, MI (US); Seth Robert Clifford, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 384 days.

(21) Appl. No.: 16/922,665

(22) Filed: Jul. 7, 2020

(65) Prior Publication Data

US 2022/0007906 A1 Jan. 13, 2022

(51) Int. Cl.

| | |
|---|---|
| ***A47L 9/14*** | (2006.01) |
| ***A47L 7/00*** | (2006.01) |
| ***A47L 9/00*** | (2006.01) |
| ***A47L 9/28*** | (2006.01) |
| ***A47L 9/32*** | (2006.01) |
| ***A47L 5/30*** | (2006.01) |
| ***A47L 9/04*** | (2006.01) |

(52) U.S. Cl.

CPC ..... *A47L 9/1463* (2013.01); *A47L 5/30* (2013.01); *A47L 7/0023* (2013.01); *A47L 9/009* (2013.01); *A47L 9/0477* (2013.01); *A47L 9/2863* (2013.01); *A47L 9/325* (2013.01)

(58) Field of Classification Search

CPC .. A47L 11/20; A47L 11/4013; A47L 11/4016; A47L 11/4083; A47L 11/4088; A47L 7/0004; A47L 7/0009; A47L 7/0023; A47L 9/1463; A47L 9/009; A47L 9/2863; A47L 9/325; A47L 5/30

USPC ..... 15/347

See application file for complete search history.

(56) References Cited

U.S. PATENT DOCUMENTS 5,548,866 A * 8/1996 Reed ..... A47L 11/4044 15/345

6,108,862 A * 8/2000 Frederick ..... A47L 9/2852 15/340.2

(Continued)

FOREIGN PATENT DOCUMENTS

CN 206365853 U 8/2017

DE 202016104991 U1 1/2017

(Continued)

OTHER PUBLICATIONS

Chinese Patent Office, Office Action re Corresponding Application No. 202121551382.9, dated Nov. 23, 2021, 2 pages, China.

(Continued)

*Primary Examiner* — Orlando E Aviles

*Assistant Examiner* — Jacob Adam Montgomery

(74) *Attorney, Agent, or Firm* — Quinn IP Law

(57) ABSTRACT

A surface cleaning apparatus is provided with a housing including an upright assembly and a base assembly moveably mounted to the upright assembly, the upright assembly forming a stalk, a fluid container provided on the housing, a fluid distributor provided in the base assembly in fluid communication with the fluid container, a working air path through the housing, a recovery container provided on the housing and defining a portion of the working air path, a suction source provided on the housing and defining a portion of the working air path, a suction nozzle provided on the base assembly.

14 Claims, 14 Drawing Sheets

(56) References Cited

U.S. PATENT DOCUMENTS

| | | | | |
|---|---|---|---|---|
| 6,167,587 | B1 * | 1/2001 | Kasper | A47L 11/34 15/389 |
| 6,658,692 | B2 | 12/2003 | Lensiewicz et al. | |
| 7,159,271 | B2 * | 1/2007 | Sepke | A47L 11/34 15/320 |
| 8,752,237 | B2 | 6/2014 | DeJonge | |
| 8,943,647 | B1 * | 2/2015 | Henderson | A47L 9/325 15/328 |
| 10,602,903 | B2 | 3/2020 | Johnson et al. | |
| 11,089,935 | B2 | 8/2021 | Nguyen | |
| 2002/0174507 | A1 * | 11/2002 | Kasper | A47L 11/4088 15/340.2 |
| 2003/0051309 | A1 * | 3/2003 | Morgan | A47L 5/34 15/373 |
| 2005/0050672 | A1 * | 3/2005 | Lenkiewicz | A47L 11/4088 15/320 |

FOREIGN PATENT DOCUMENTS

| | | | | |
|---|---|---|---|---|
| DE | 202017107509 | U1 | | 4/2018 |
| GB | 2419807 | A | * | 5/2006 |
| WO | 2011100678 | A2 | | 8/2011 |

OTHER PUBLICATIONS

European Patent Office, Partial European Search Report re Corresponding Application No. 21183020.3-1016, dated Jan. 3, 2022. 10 pages, Munich, Germany.

* cited by examiner

SURFACE CLEANING APPARATUS

BACKGROUND

Extraction cleaners are well-known surface cleaning apparatuses for deep cleaning carpets and other fabric surfaces, such as upholstery. Most carpet extractors comprise a fluid delivery system that delivers cleaning fluid to a surface to be cleaned and a fluid recovery system that extracts spent cleaning fluid and debris, which may include dirt, dust, stains, soil, hair, and other debris, from the surface. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. An agitator can be provided for agitating the cleaning fluid on the surface. The fluid recovery system usually comprises a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank. Other surface cleaning apparatuses include vacuum cleaners, which can have a nozzle adjacent the surface to be cleaned in fluid communication with a collection system and an agitator can be provided for agitating the cleaning fluid on the surface.

BRIEF DESCRIPTION

According to one aspect of the present disclosure surface cleaning apparatus, comprising a housing including an upright assembly and a base assembly moveably mounted to the upright assembly, the upright assembly comprising at least one of: an inverted T-shape or a set of sections selectively coupled together to form a stalk, a fluid container provided on the housing, a fluid distributor provided in the base assembly in fluid communication with the fluid container, a working air path through the housing, a recovery container provided on the housing and defining a portion of the working air path, a suction source provided on the housing and defining a portion of the working air path and a suction nozzle provided on the base assembly.

According to another aspect of the present disclosure surface cleaning apparatus, including a housing including an upright assembly forming a stalk and a base mounted to the upright assembly and adapted for movement across a surface to be cleaned, a working air path through the housing, a recovery container provided on the housing and defining a portion of the working air path, a suction source provided on the housing and defining a portion of the working air path, and a pedal assembly provided in the housing and configured to selectively allow pivotal motion of the upright assembly with respect to the base until released, the pedal assembly including a pivoting pedal extending from a rear of the housing, the pivoting pedal including an actuating surface coupled to an axle via a first arm member and a second arm member extending away from the axle, the second arm member including a portion that is operably coupled to the sliding latch, the axle rotatably mounted to a portion of the upright assembly a sliding latch operably coupled to the pivoting pedal and moveable between a locked position wherein a portion of the sliding latch engages the base and a released position and a biasing mechanism configured to bias the sliding latch into the locked position.

DETAILED DESCRIPTION

Figure 1:
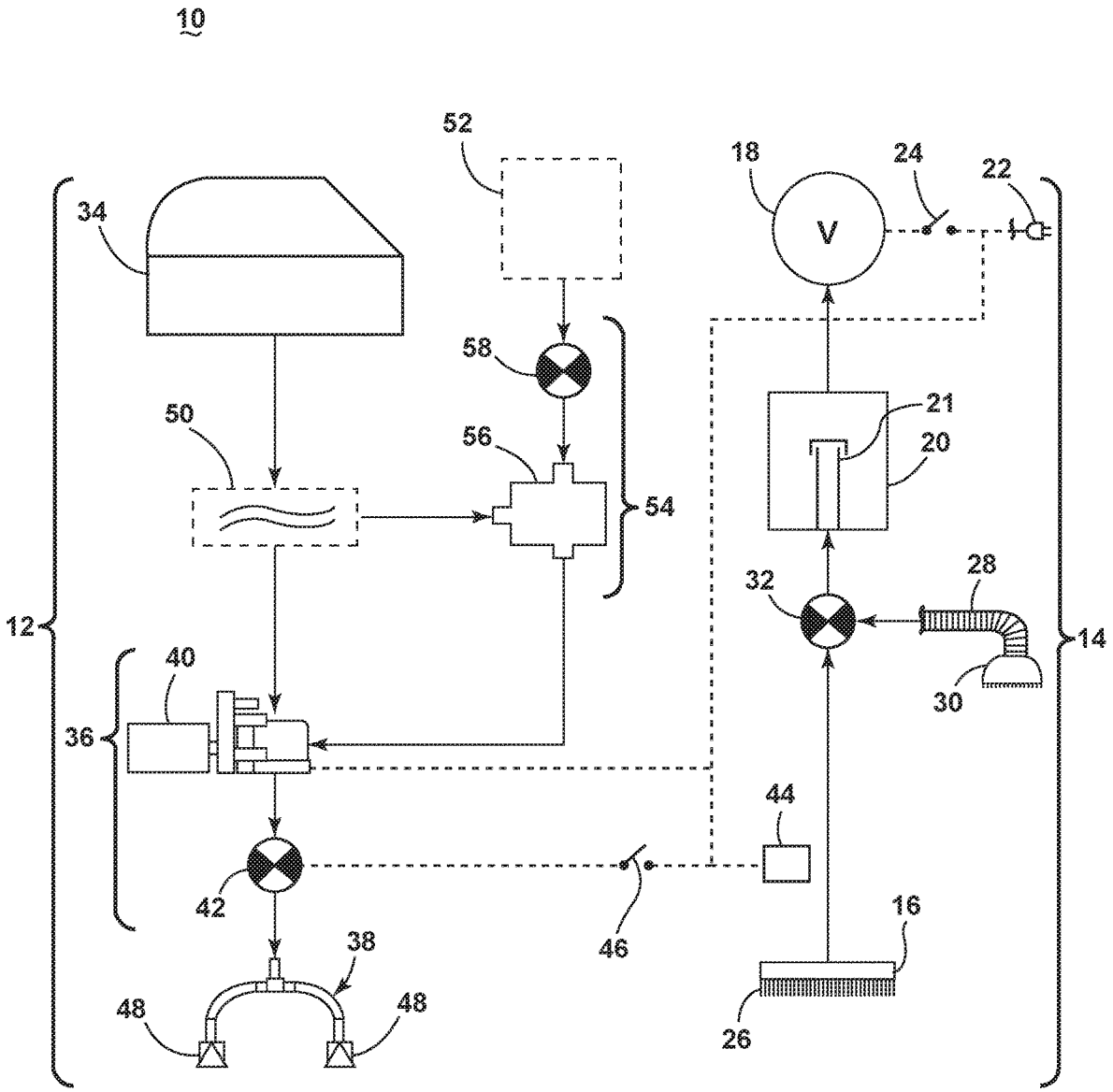
FIG. 1 is a schematic view of a surface cleaning apparatus in the form of an extraction cleaner according to an aspect of the present disclosure.

FIG. 1 is a schematic view of various functional systems of a surface cleaning apparatus in the form of an extraction cleaner 10. The functional systems of the extraction cleaner 10 can be arranged into any desired configuration, such as an upright extraction device having a base and an upright body for directing the base across the surface to be cleaned, a canister device having a cleaning implement connected to a wheeled base by a vacuum hose, a portable extractor adapted to be hand carried by a user for cleaning relatively small areas, or a commercial extractor. Any of the aforementioned extraction cleaners can be adapted to include a flexible vacuum hose, which can form a portion of the working air conduit between a nozzle and the suction source.

The extraction cleaner 10 can include a fluid delivery system 12 for storing cleaning fluid and delivering the cleaning fluid to the surface to be cleaned and a fluid recovery system 14 for removing the spent cleaning fluid and debris from the surface to be cleaned and storing the spent cleaning fluid and debris.

The fluid recovery system 14 can include a suction nozzle 16, a suction source in fluid communication with the suction nozzle 16 for generating a working air stream, and a recovery container 20 for separating and collecting fluid and debris from the working airstream for later disposal. A separator 21 can be formed in a portion of the recovery container 20 for separating fluid and entrained debris from the working airstream.

The suction source, such as a motor/fan assembly 18, is provided in fluid communication with the recovery container 20. The motor/fan assembly 18 can be electrically coupled to a power source 22, such as a battery or by a power cord plugged into a household electrical outlet. A suction power switch 24 between the motor/fan assembly 18 and the power source 22 can be selectively closed by the user, thereby activating the motor/fan assembly 18.

The suction nozzle 16 can be provided on a base or cleaning head adapted to move over the surface to be cleaned. An agitator 26 can be provided adjacent to the suction nozzle 16 for agitating the surface to be cleaned so that the debris is more easily ingested into the suction nozzle 16. Some examples of agitators include, but are not limited to, a horizontally-rotating brushroll, dual horizontally-rotating brushrolls, one or more vertically-rotating brushrolls, or a stationary brush.

The extraction cleaner 10 can also be provided with above-the-floor cleaning features. A vacuum hose 28 can be selectively fluidly coupled to the motor/fan assembly 18 for above-the-floor cleaning using an above-the floor cleaning tool 30 with its own suction inlet. A diverter assembly 32 can be selectively switched between on-the-floor and above-the floor cleaning by diverting fluid communication between either the suction nozzle 16 or the vacuum hose 28 with the motor/fan assembly 18. Alternatively, the vacuum hose 28 can be plugged directly into the airpath via a port, effectively blocking the path to the suction nozzle 16 and redirecting the suction to the vacuum hose 28. Air can be automatically redirected to the vacuum hose 28 either based on handle position or by direct insertion of the vacuum hose 28.

The fluid delivery system 12 can include at least one fluid container 34 for storing a supply of fluid. The fluid can comprise one or more of any suitable cleaning fluids, including, but not limited to, water, compositions, concentrated detergent, diluted detergent, etc., and mixtures thereof. For example, the fluid can comprise a mixture of water and concentrated detergent.

The fluid delivery system 12 can further comprise a flow control system 36 for controlling the flow of fluid from the container 34 to a fluid distributor 38. In one configuration, the flow control system 36 can comprise a pump 40 which pressurizes the system 12 and a flow control valve 42 which controls the delivery of fluid to the fluid distributor 38. An actuator 44 can be provided to actuate the flow control system 36 and dispense fluid to the distributor 38. The actuator 44 can be operably coupled to the valve 42 such that pressing the actuator 44 will open the valve 42. The valve 42 can be electrically actuated, such as by providing an electrical switch 46 between the valve 42 and the power source 22 that is selectively closed when the actuator 44 is pressed, thereby powering the valve 42 to move to an open position. In one example, the valve 42 can be a solenoid valve. The pump 40 can also be coupled with the power source 22. In one example, the pump 40 can be a centrifugal pump. In other non-limiting examples, the pump 40 can be a solenoid pump, diaphragm pump, gear pump, peristaltic pump, or turbine driven pump.

The fluid distributor 38 can include at least one distributor outlet 48 for delivering fluid to the surface to be cleaned. The at least one distributor outlet 48 can be positioned to deliver fluid directly to the surface to be cleaned, or indirectly by delivering fluid onto the agitator 26. The at least one distributor outlet 48 can comprise any structure, such as a nozzle or spray tip; multiple outlets 48 can also be provided. As illustrated in FIG. 1, the fluid distributor 38 can comprise two spray tips 48 which distribute cleaning fluid to the surface to be cleaned. For above-the-floor cleaning, the cleaning tool 30 can include an auxiliary distributor (not shown) coupled with the fluid delivery system 12.

Optionally, a heater 50 can be provided for heating the cleaning fluid prior to delivering the cleaning fluid to the surface to be cleaned. In the example illustrated in FIG. 1, an in-line heater 50 can be located downstream of the container 34 and upstream of the pump 40. Other types of heaters 50 can also be used. In yet another example, the cleaning fluid can be heated using exhaust air from a motor-cooling pathway for the motor/fan assembly 18.

As another option, the fluid delivery system can be provided with an additional container 52 for storing a cleaning fluid. For example, the first container 34 can store water and the second container 52 can store a cleaning agent such as detergent. The containers 34, 52 can, for example, be defined by a supply tank and/or a collapsible bladder. In one configuration, the first container 34 can be a bladder that is provided within the recovery container 20. Alternatively, a single container can define multiple chambers for different fluids.

In the case where multiple containers 34, 52 are provided, the flow control system 36 can further be provided with a mixing system 54 for controlling the composition of the cleaning fluid that is delivered to the surface. The composition of the cleaning fluid can be determined by the ratio of cleaning fluids mixed together by the mixing system. As shown herein, the mixing system 54 includes a mixing manifold 56 that selectively receives fluid from one or both of the containers 34, 52. A mixing valve 58 is fluidly coupled with an outlet of the second container 52, whereby when mixing valve 58 is open, the second cleaning fluid will flow to the mixing manifold 56. By controlling the orifice of the mixing valve 58 or the time that the mixing valve 58 is open, the composition of the cleaning fluid that is delivered to the surface can be selected.

In yet another configuration of the fluid delivery system 12, the pump 40 can be eliminated and the flow control system 36 can comprise a gravity-feed system having a valve fluidly coupled with an outlet of the container(s) 34, 52, whereby when valve is open, fluid will flow under the force of gravity to the fluid distributor 38. The valve can be mechanically actuated or electrically actuated, as described above.

The extraction cleaner 10 shown in FIG. 1 can be used to effectively remove debris and fluid from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

In operation, the extraction cleaner 10 is prepared for use by coupling the extraction cleaner 10 to the power source 22, and by filling the first container 34, and optionally the second container 52, with cleaning fluid. Cleaning fluid is selectively delivered to the surface to be cleaned via the fluid delivery system 12 by user-activation of the actuator 44, while the extraction cleaner 10 is moved back and forth over the surface. The agitator 26 can simultaneously agitate the cleaning fluid into the surface to be cleaned. During operation of the recovery system 14, the extraction cleaner 10 draws in fluid and debris-laden working air through the suction nozzle 16 or cleaning tool 30, depending on the position of the diverter assembly 32, and into the downstream recovery container 20 where the fluid debris is substantially separated from the working air. The airstream then passes through the motor/fan assembly 18 prior to being exhausted from the extraction cleaner 10. The recovery container 20 can be periodically emptied of collected fluid and debris.

Figure 2:
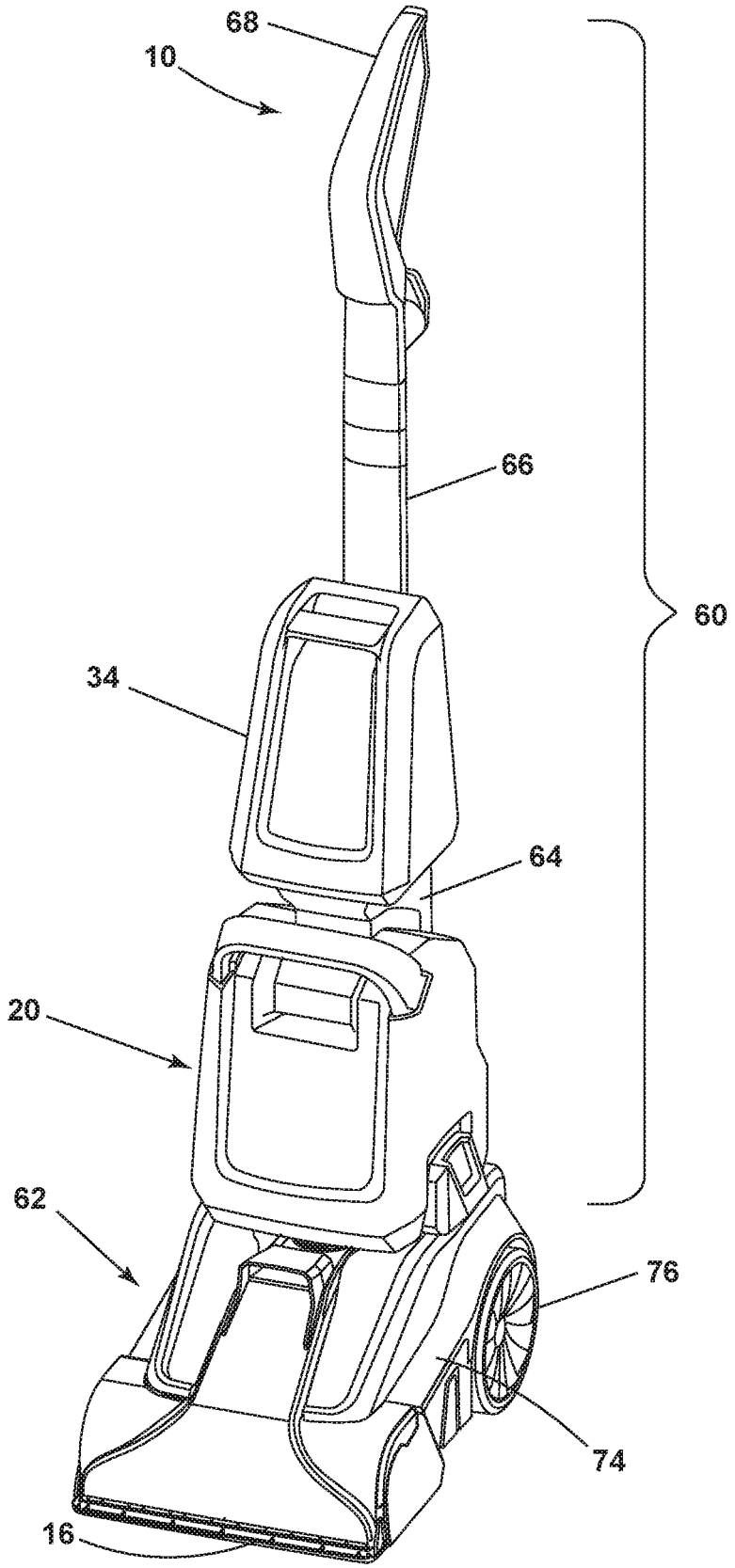
FIG. 2 is a front perspective view of an extraction cleaner according to an aspect of the present disclosure.

FIG. 2 is a perspective view illustrating one non-limiting example of the extraction cleaner 10 according to an aspect of the present disclosure. As illustrated herein, the extraction cleaner 10 is an upright extraction cleaner having a housing that includes an upright assembly 60 that is pivotally connected to a base assembly 62 for directing the base assembly 62 across the surface to be cleaned. The extraction cleaner 10 can comprise the various systems and components schematically described for FIG. 1, including the fluid delivery system 12 for storing and delivering a cleaning fluid to the surface to be cleaned and the recovery system 14 for extracting and storing the dispensed cleaning fluid, dirt and debris from the surface to be cleaned. The various systems and components schematically described for FIG. 1, including the fluid delivery system 12 and fluid recovery system 14 can be supported by either or both the base assembly 62 and the upright assembly 60.

For purposes of description related to the figures, the terms "upper," "lower," "right," "left," "rear," "front," "vertical," "horizontal," "inner," "outer," and derivatives thereof shall relate to the invention as oriented in FIG. 2 from the perspective of a user behind the extraction cleaner 10, which defines the rear of the extraction cleaner 10. However, it is to be understood that the invention may assume various alternative orientations, except where expressly specified to the contrary.

The upright assembly 60 includes a main support section or frame 64 supporting components of the fluid delivery system 12 including, but not limited to the fluid container 34. The upright assembly 60 also has an elongated handle 66 extending upwardly from the frame 64 that is provided with a handgrip 68 at one end that can be used for maneuvering the extraction cleaner 10 over a surface to be cleaned. The upright assembly 60 is moveable with respect to the base assembly 62. More specifically, the upright assembly 60 can be pivoted with respect to the base assembly 62.

Figure 6A:
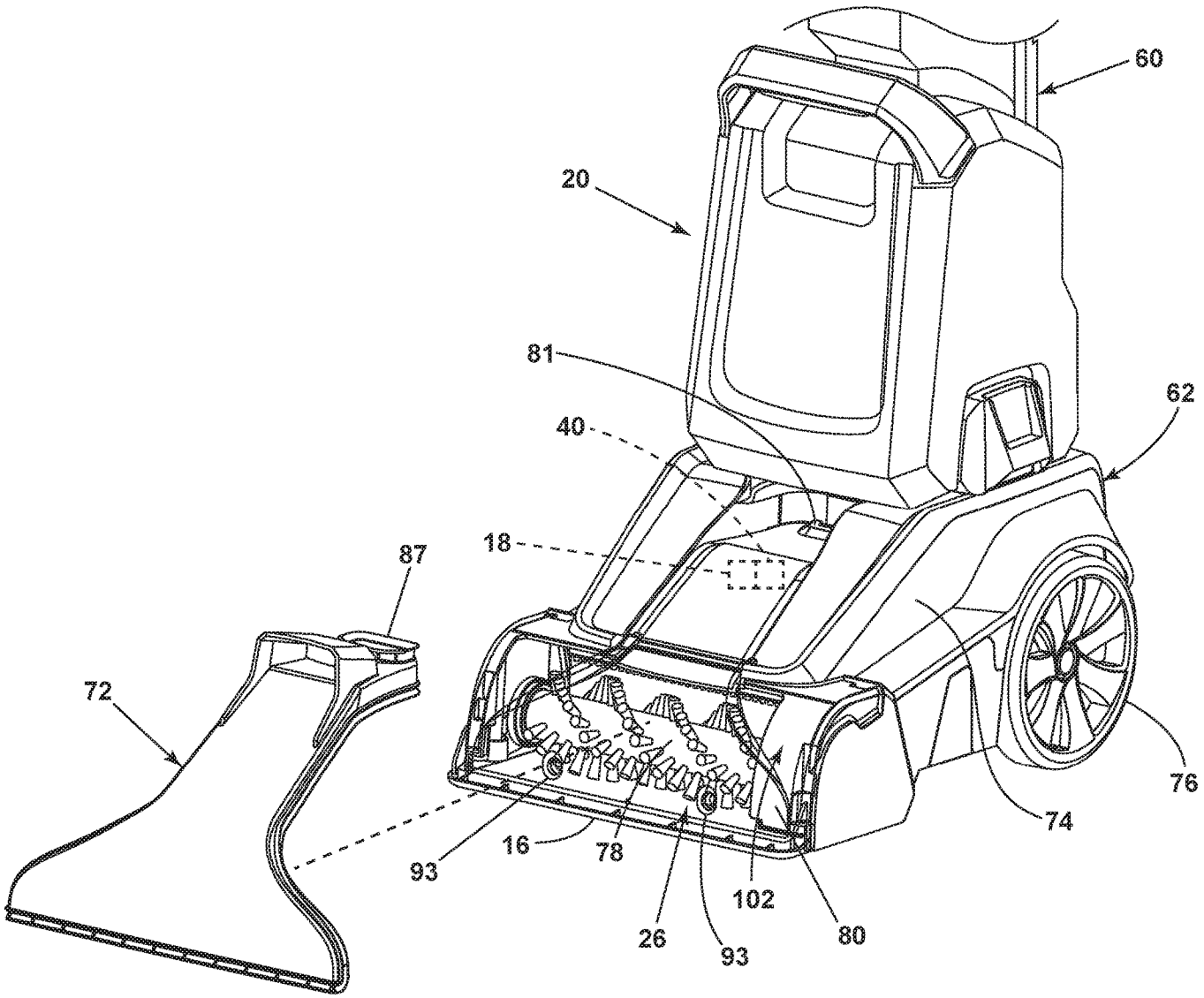
FIG. 6A is a perspective view of a portion of the extraction cleaner of FIG. 2 with a nozzle cover removed.
Figure 7:
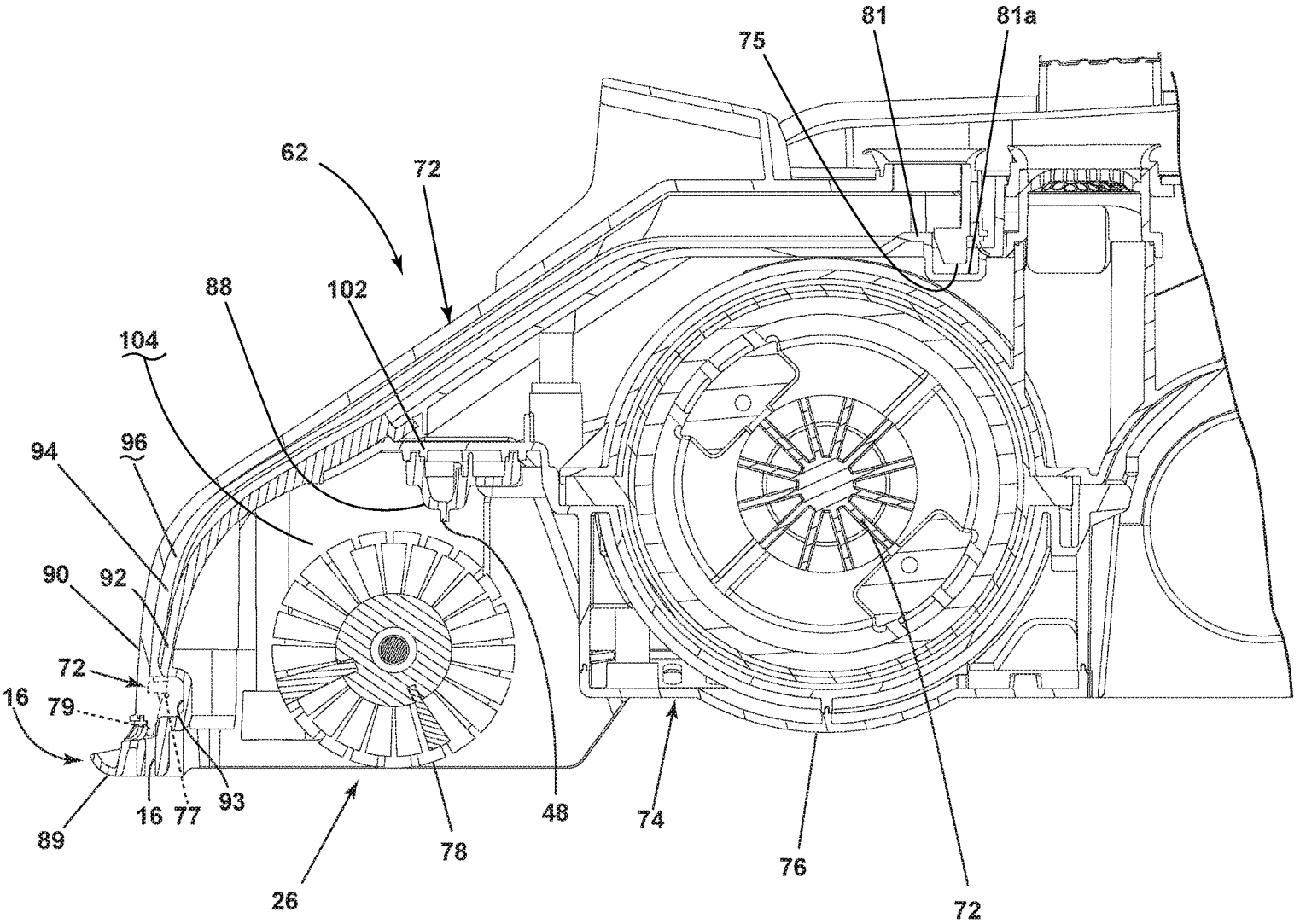
FIG. 7 is a cross-sectional view of a portion of the base assembly of the extraction cleaner of FIG. 2.

The base assembly 62 includes a base housing 74 supporting components of the fluid delivery system 12 and the recovery system 14, including, but not limited to, the suction nozzle 16, the motor/fan assembly 18 (FIG. 6A), the recover container 20, the agitator 26 (FIG. 6A), the pump 40 (FIG. 6A), the fluid distributor 48 (FIG. 7). Wheels 76 at least partially support the base housing 74 for movement over the surface to be cleaned.

Figure 3:
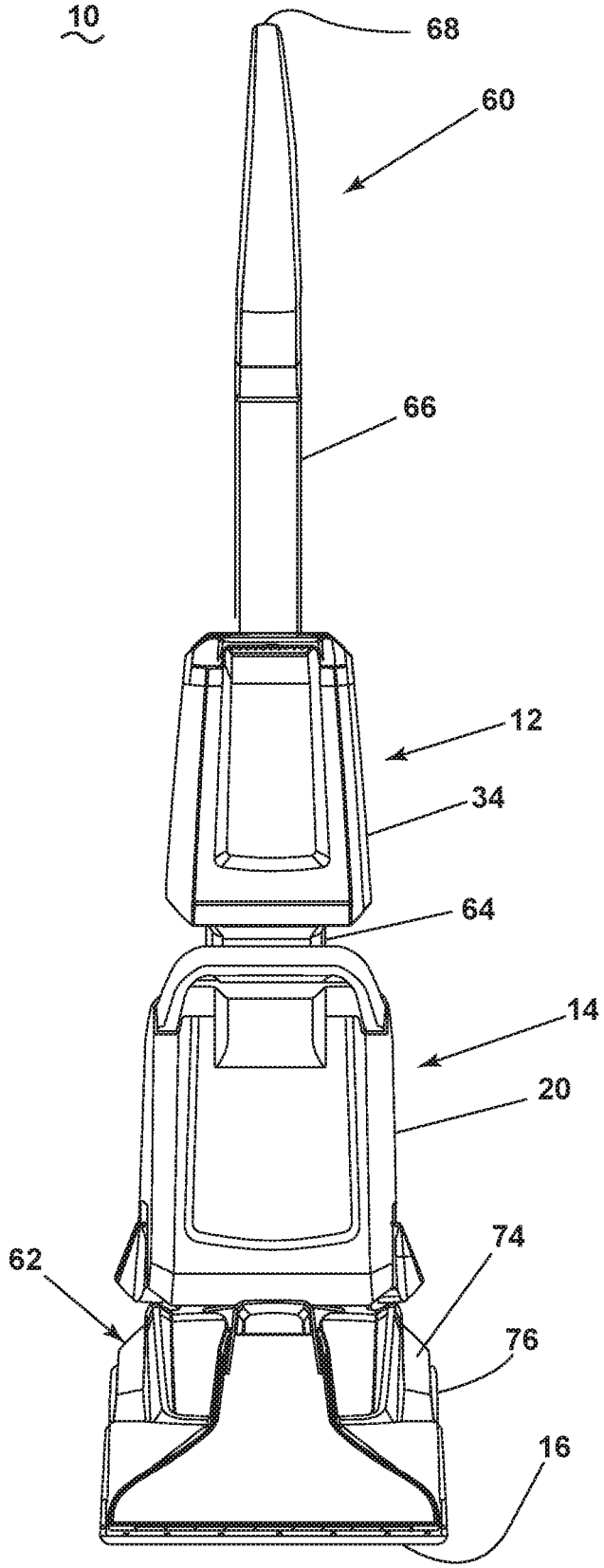
FIG. 3 is a front view of the extraction cleaner of FIG. 2.
Figure 4:
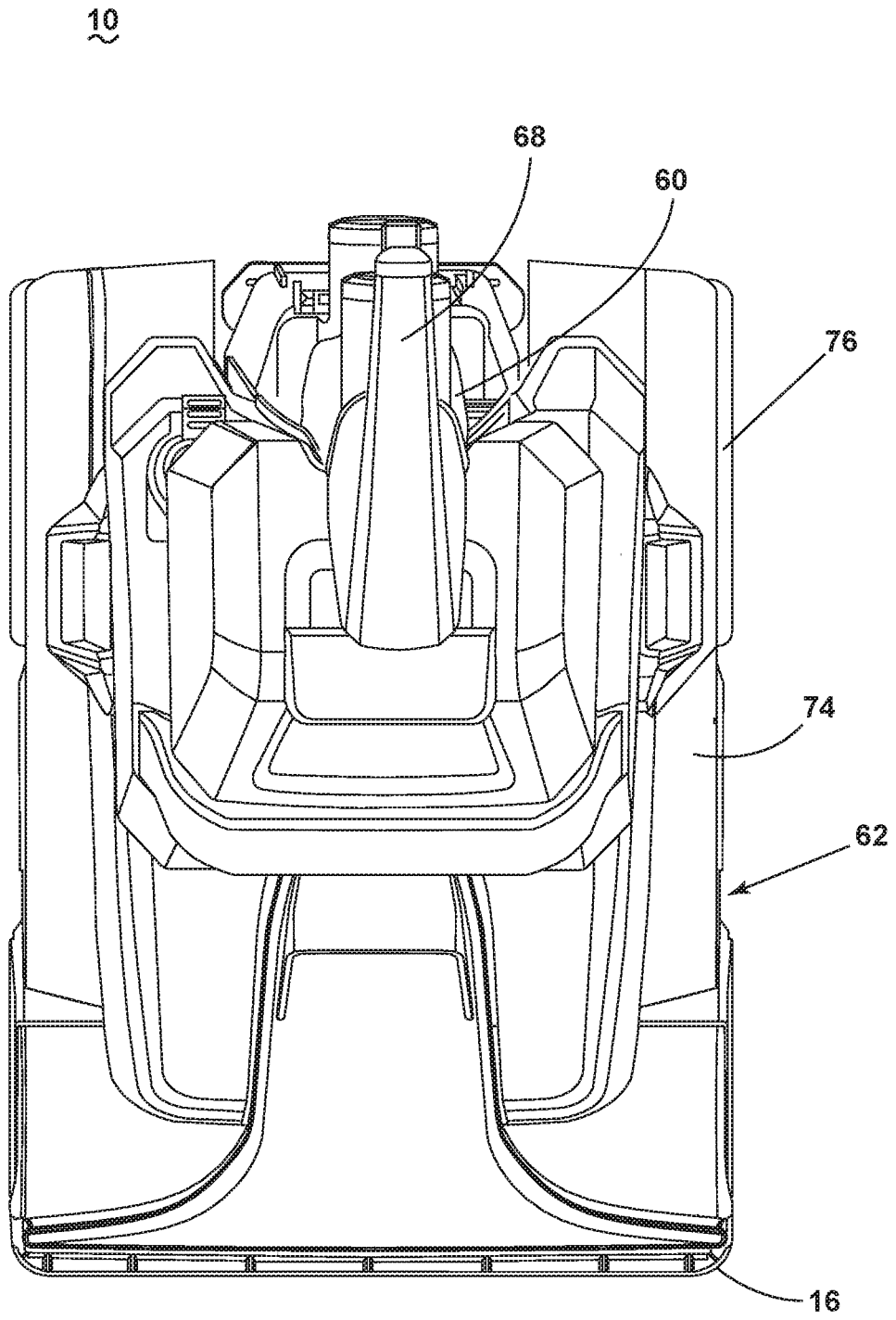
FIG. 4 is a top view of the extraction cleaner of FIG. 2.
Figure 5:
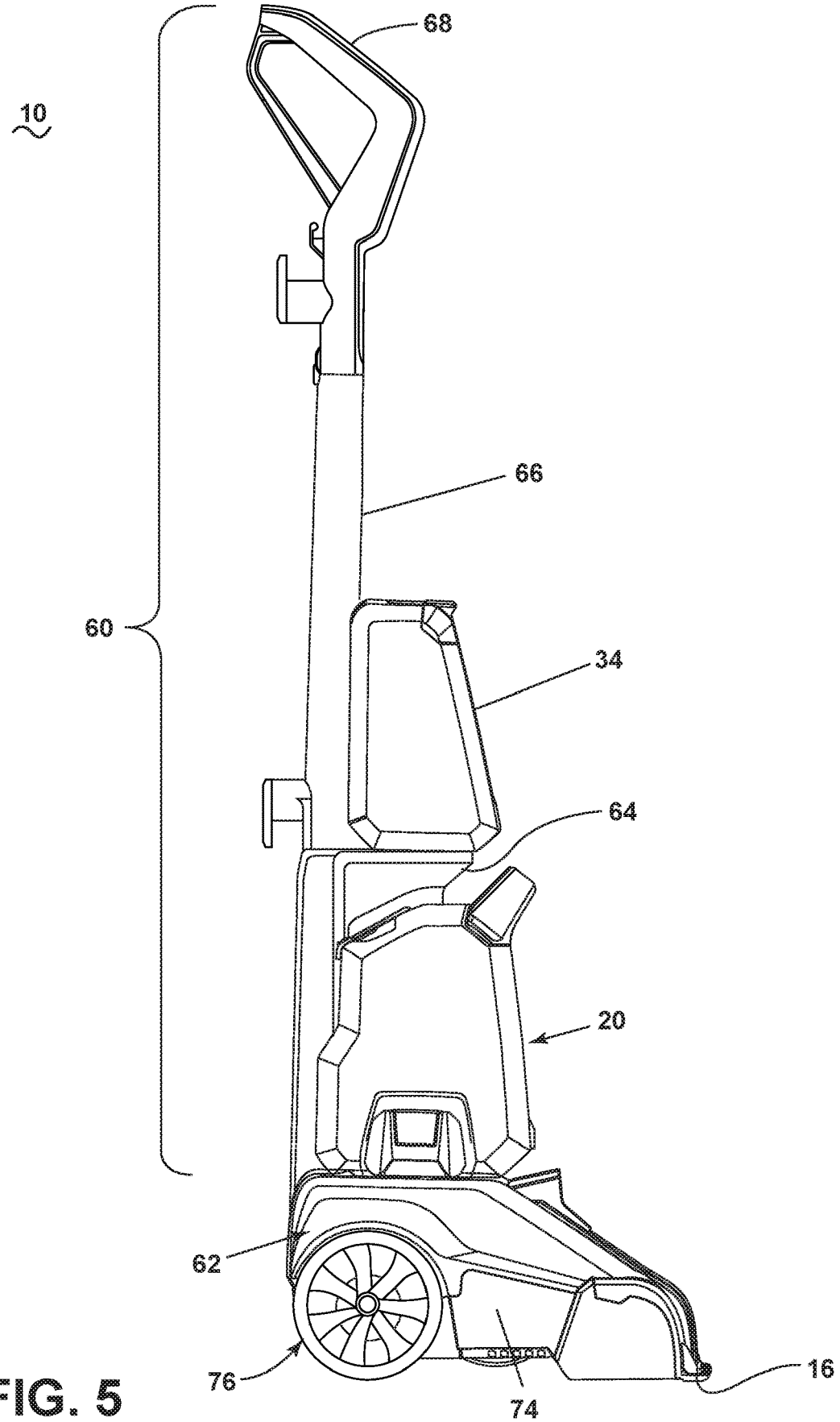
FIG. 5 is a side view of the extraction cleaner of FIG. 2.

FIG. 3 illustrates a front view of the extraction cleaner 10, FIG. 4 illustrates a top view of the extraction cleaner 10, and FIG. 5 illustrates one side view of the extraction cleaner 10, the other side view of the extraction cleaner 10 can be substantially the same and these figures illustrate among other things the ornamental appearance of the extraction cleaner 10 when it is in an upright storage position.

FIG. 6A illustrates a lower portion of the extraction cleaner 10 with a nozzle cover 72 removed. The nozzle cover 72 can be configured to be removable from the base assembly 62. As can be more clearly seen with the nozzle cover 72 removed an agitator housing 102 includes a transparent body portion 80 at a forward portion of the base assembly 62. The transparent body portion 80 remains on the base assembly 62 when the nozzle cover 72 is removed. The nozzle cover 72 does not require conventional fasteners or a complicated latching mechanism to be coupled to the base assembly 62. Instead, the nozzle cover 72 is retained utilizing flexural tension of the curved part of the nozzle cover 72 to remain engaged with a forward face of the transparent body portion 80. Further still, one or more retention mechanisms can be utilized.

A protrusion 81 forming a portion of a first retention mechanism is provided at an upper portion of the base assembly 62. A set of recesses 93 are located at the front of the agitator housing 102 and form a portion of a second retention mechanism.

Figure 6B:
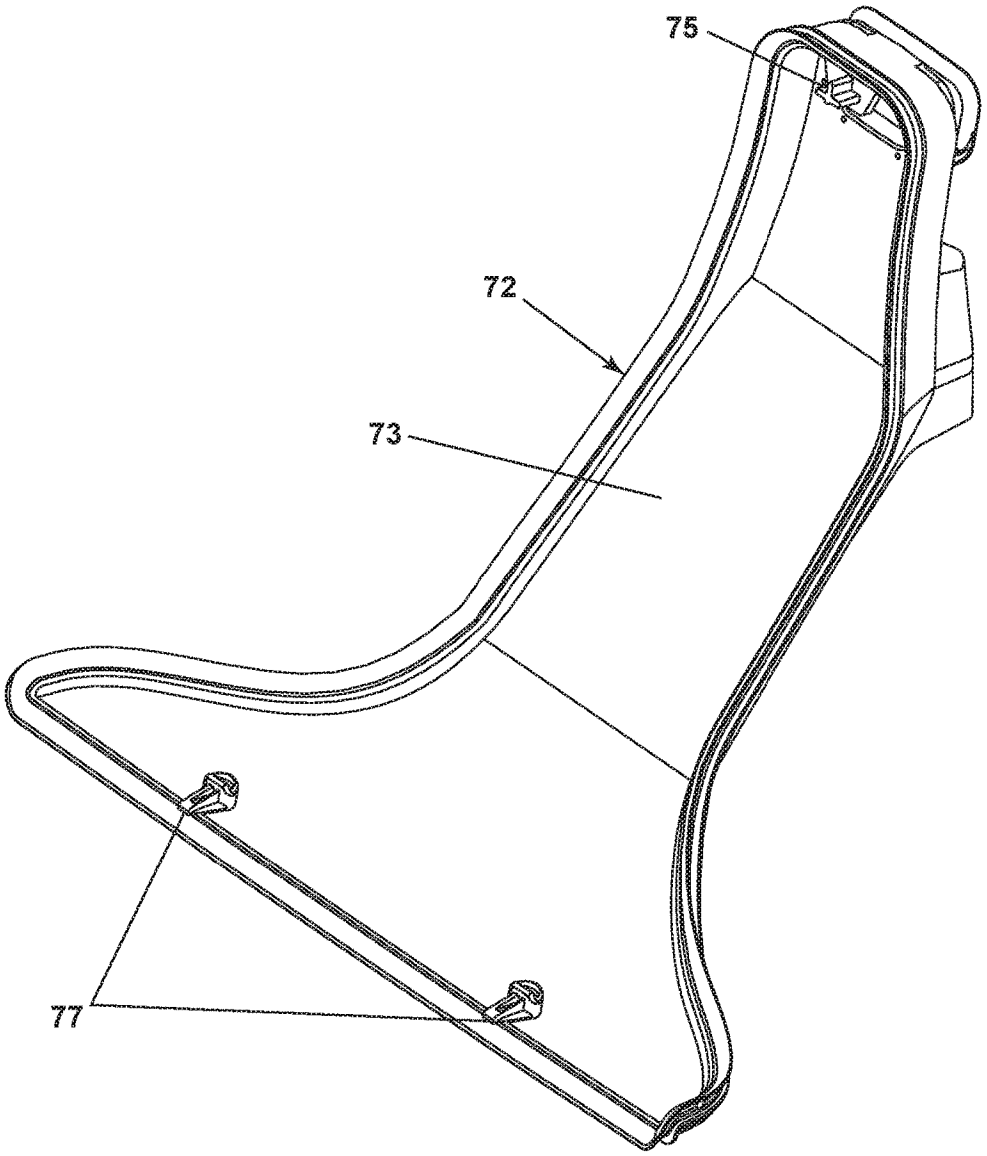
FIG. 6B is a perspective view of a rear of the nozzle cover of FIG. 6A.

FIG. 6B illustrates a rear view of the nozzle cover 72 including rear surface 73. Rear surface 73 of the nozzle cover abuts the forward face of the transparent body portion 80 of the agitator housing 102. The rear surface 73 of the nozzle cover 72 includes a set of engagement features. The engagement features include a top post 75 located near the nozzle outlet 87 (FIG. 6A) at the opposite end to engage the protrusion 81 (FIG. 6A) on the base assembly. Further, a set of lower posts 77 along the rear surface 73 of the lower front of the nozzle cover 72 are also included. While the set of engagement features can include any suitable shape or profile, posts having a vertical rib and horizontal rib have been illustrated. It will be understood that the nozzle cover 72 is removable from the base housing 74 without tools. The nozzle cover 72 is easy to remove as a user just lifts to provide a force to overcome the fit created by the set of engagement features. The user can then clean and rinse off the nozzle cover 72. It is contemplated that the nozzle cover 72 can also be transparent including clear material or a tinted translucent material.

When assembled, the top post 75 is received within a recess 81*a* behind the protrusion 81 as better illustrated in FIG. 7. Each of the set of lower posts 77 (shown in phantom in FIG. 7) is received in one of the correspondence set of recesses 93 and tension of the nozzle cover 72 keeps it in tight engagement with the base assembly 62. A seal 89 can be located at a lower edge of the agitator housing 102 around the perimeter of the nozzle cover 72 when assembled. The seal 89 can be an over-molded seal. The seal 89 provides benefit over previously used separate rope seals, which are difficult and inconsistent to assemble and may fall out during consumer servicing. The seal 89 around the nozzle cover 72 further ensures a tight fit between the nozzle cover 72 and the agitator housing 102. For example, a downward protrusion 79 of the nozzle cover 72 may be received within the seal 89 and utilized as an additional retention mechanism. The location of the engagement features and tension provided by the compression of the seal 89 aids in keeping the nozzle cover 72 retained. Further still, the recovery container 20 is mounted to the base assembly 62 and this also holds the nozzle cover 72 in place during use.

Figure 10:
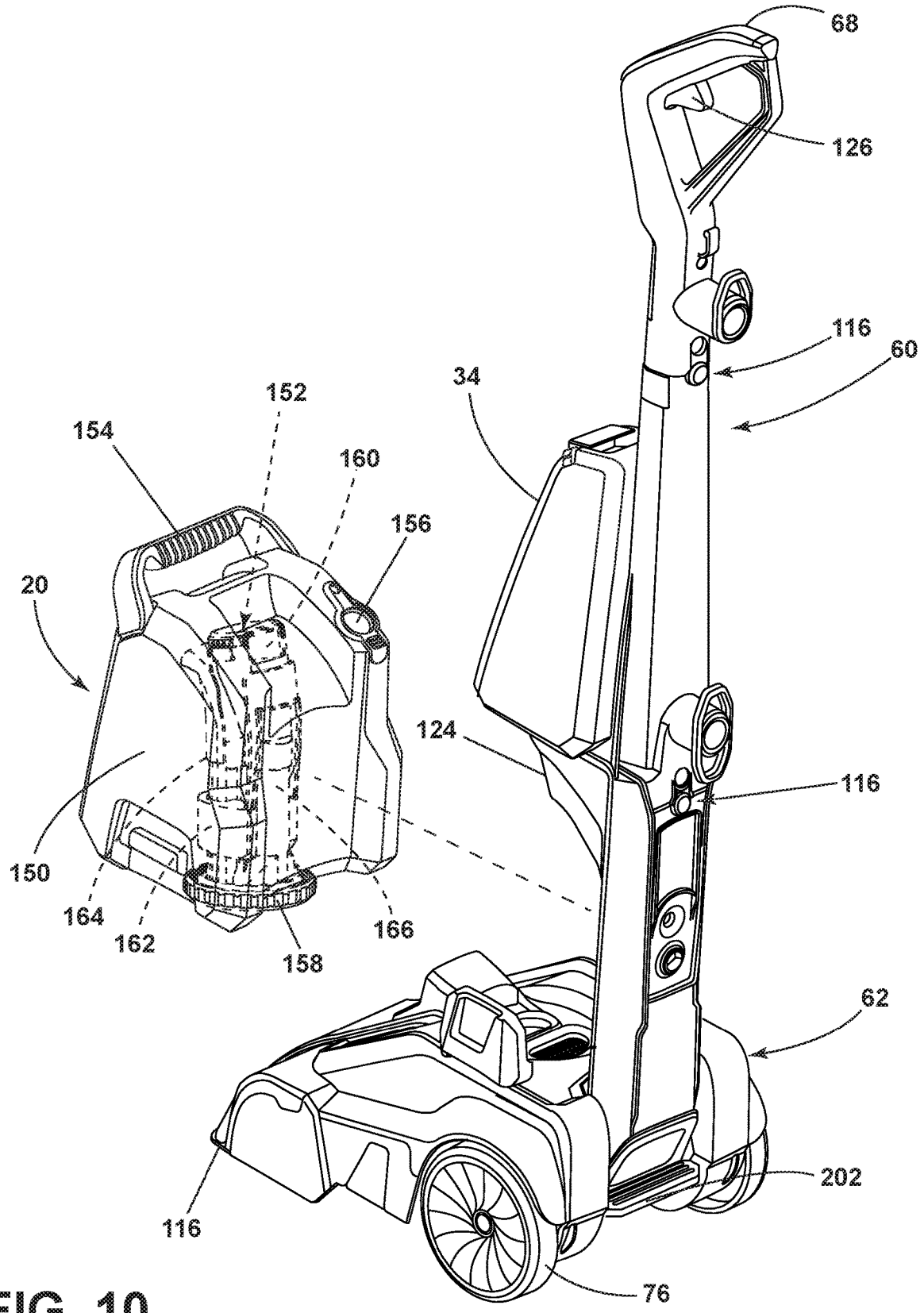
FIG. 10 is a rear perspective view of the extraction cleaner of FIG. 2, with a tank removed.

FIG. 7 also better illustrates that the nozzle cover 72 includes a single piece that can be secured to the base housing 74 to define a portion of the suction nozzle flow path with an outlet 87 leading to the air/liquid separator assembly 152 (FIG. 10). The suction nozzle 16 of the extraction cleaner 10 can include a front wall 90 formed by the nozzle cover 72 and a rear wall 92 formed by the front of the agitator housing 102. The suction nozzle 16 defines a narrow suction pathway 94 therebetween with an opening forming a suction nozzle inlet 96 adjacent the surface to be cleaned. The suction pathway 94 is in fluid communication with the outlet 87 (FIG. 6A) leading to the recovery container 20. It will be understood that the front and rear walls 90, 92 can be fixedly attached together in a non-separable configuration. For example, the front and rear walls 90, 92 can be welded together.

The agitator housing 102 defines an agitator chamber 104. The agitator 26 of the illustrated example includes a horizontally-rotating brushroll 78 located within the agitator chamber. The brushroll 78 can be operatively coupled with the motor/fan assembly 18 (FIG. 6A) via a transmission (not shown), which can include one or more belts, gears, shafts, pulleys, or combinations thereof. The pump 40 (FIG. 6A) may also be operatively coupled with the motor/fan assembly 18 via the same transmission or a separate transmission.

The fluid distributor 38 (FIG. 1) includes a conduit that supplies cleaning fluid from the fluid container 34 (FIG. 1) to a spray bar 88 having a plurality of distributor outlets 48 for the fluid distributor 38 (FIG. 1). The distributor outlets 48 dispense cleaning fluid onto the brushroll 78. A conduit can extend from the base assembly 62 to the fluid container 34 in the upright assembly 60, and may be made up of one or more flexible and/or rigid sections. The pump 40 (FIG. 6A) may form a portion of the conduit and a flow control assembly 138 can be fluidly coupled between the fluid container and the conduit 86 to control dispensing thereto. The spray bar 88 can be mounted on the agitator housing 102, and a portion of the agitator housing 102 may form a portion of the conduit that supplies cleaning fluid from the fluid container 34 to the spray bar 88.

Figure 8:
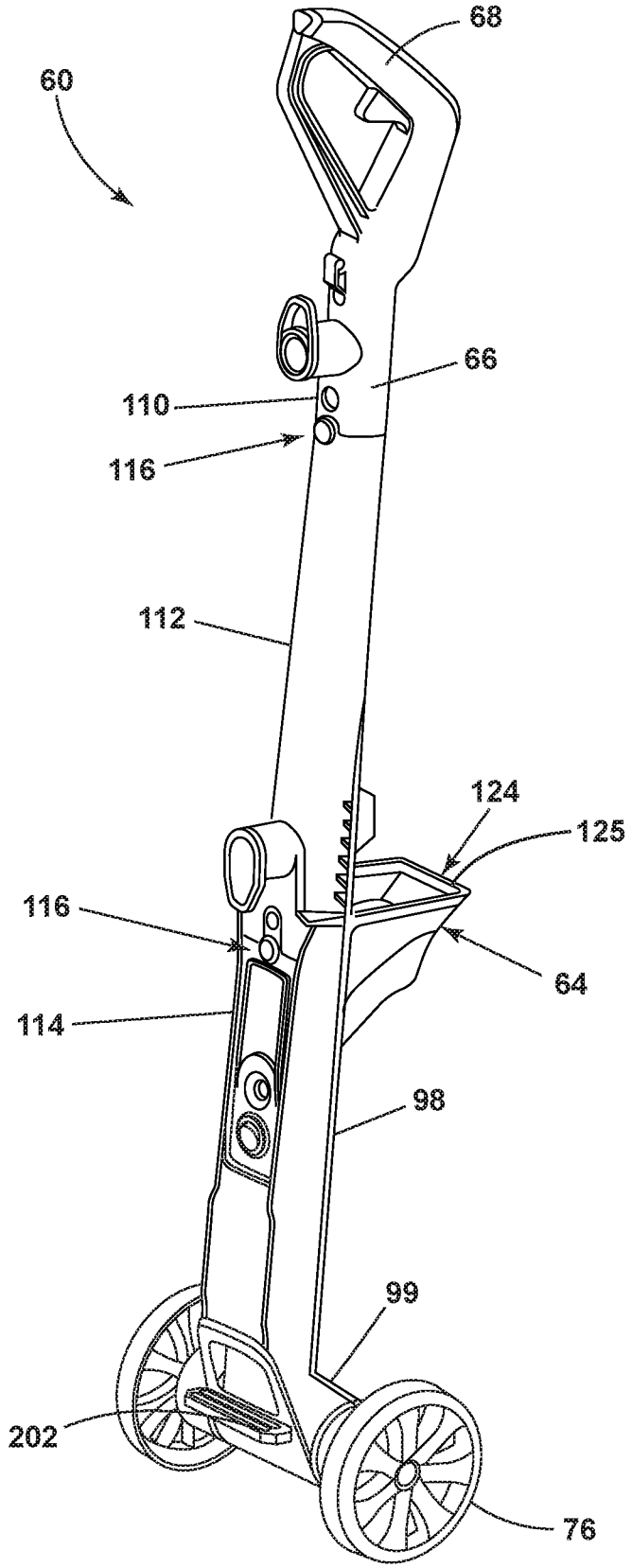
FIG. 8 is a perspective view of the upright assembly of the extraction cleaner of FIG. 2.

FIG. 8 shows a perspective view of the upright assembly 60. As can more clearly be seen the main support section or frame 64 is generally in an inverted T-shape. With the stalk or stem 98 of the inverted T-shape extending upward into the elongated handle 66 and extending downward to the arms of the inverted T-shape. The first arm 99 of the inverted T-shape extends forwardly from the stem 98. The second arm of the inverted T-shape can be defined by the pivoting pedal 202, which extends from a rearward portion of a base of the stem 98. The first arm 99 can be shaped or contoured to aid in supporting the base assembly 62 and to facilitate pivoting movement of the upright assembly 60 relative to the base assembly 62.

Further, as illustrated the stem 98 can comprises of a set of sections operably coupled together. An upper section 110, an intermediate section 112, and a lower section 114 have been illustrated although it will be understood that any number of sections can be included. Latch assemblies 116 can be includes at the joints between the respective sections to retain two sections together. The latch assemblies 116 allow the upper section 110, intermediate section 112, and lower section 114 to be mounted together without the need for tools or fasteners such as screws.

Figure 9:
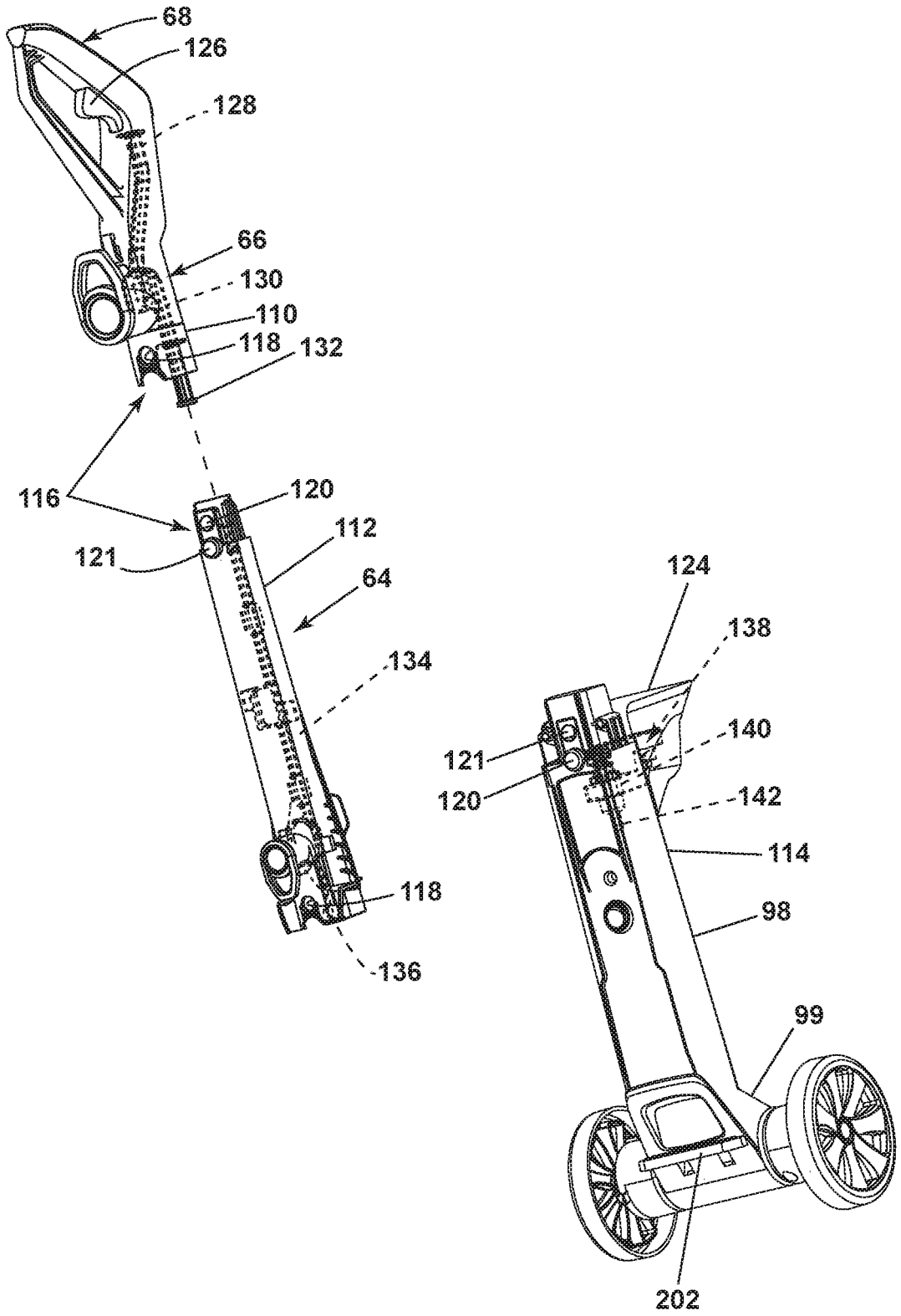
FIG. 9 is a partially exploded view of the upright assembly of FIG. 8.

The sections have been illustrated in an exploded view in FIG. 9 and it can more easily be seen that each latch assembly 116 includes a receiver 118 and a flexible latch 120. It will be understood that either of the adjacent sections can include one of the receiver 118 or the flexible latch 120 and an other of the adjacent sections can include the complementary flexible latch 120 or receiver 118. By way of non-limiting example, a receiver 118 is include at a lower end of the upper section 110. In the illustrated example, the receiver 118 includes an opening having a shape, contour, or profile adapted to receive a similarly shaped catch of the flexible latch 120 that is located at an upper end of the intermediate section 112. In the illustrated example but the receiver 118 and the flexible latch 120 are circular in shape. However, it will be understood that any suitable shapes can be utilized so long as the flexible latch includes a first profile and the receiver includes a recess or opening having a complementary profile adapted to receive the catch therein. Further still, a button 121 can be operably coupled to the flexible latch 120. In the illustrated example both may be mounted on a plate, which can be received proximate the receiver 118 when the sections are mounted together. A portion of the receiver 118 can also form a stop configured to abut the button 121 when the sections are mounted together. The upper section 110 can be joined to the intermediate section 112 by insertion of the flexible latch 120 into the receiver 118. A deformation of the flexible latch 120 may occur during assembly and the intermediate section 112 can be snapped into the upper section. This can include that a portion of the flexible latch is moved inward and a compression spring mounted behind the flexible latch provides an outward spring force. Once the upper section 110 and the intermediate section 112 are assembled, the receiver 118 is configured to retain the flexible latch 120. An inward force exerted on the flexible latch 120 and/or the button 121 by a user can release the flexible latch 120 from the receiver 118 and allow the upper section 110 to be separated from the intermediate section.

By way of further non-limiting example, a lower end of the intermediate section 112 includes a receiver 118 into which a flexible latch 120 on the upper portion of the lower section 114 can be snapped into. While the latch assemblies 116 have been illustrated on the set of sections in this manner it will be understood that they be re-arranged so that the latch and receiver are on either of the adjacent sections.

Further still, the stem 98 can include one or more receivers for supporting components of the fluid delivery system 12 including, but not limited to the fluid container 34. As illustrated a container receiver 124 is included for receiving the fluid container 34 for support on the upright assembly 60. The container receiver 124 may further include features for coupling the fluid containers 34 with the fluid delivery system 12 of the extraction cleaner 10. The container receiver 124 includes a platform that is provided on the frame 64 for supporting the fluid container 34. An upwardly extending perimeter 125, integral with the frame 64, is adapted to nest a lower portion of the fluid container 34, but leaves a majority of the fluid container 34 visible to the user. A flow control assembly 138 (FIG. 9) includes a valve seat located in the container receiver 124. The flow control assembly 138 is adapted for fluidly coupling with a valve assembly (not shown) of the fluid container 34 when the fluid container 34 is seated within the container receiver 124. In the illustrated example, the container receiver 124 is configured to support the fluid container 34 on the upright assembly 60 and above the recovery container 20, which is located on the base assembly 62.

In one configuration, the fluid delivery system 12 can comprise a gravity-feed system and a flow controller can be included within the upright assembly 60. By way of non-limiting example, the flow control assembly 138 can include a valve, whereby when the valve is open, liquid will flow under the force of gravity, through the fluid delivery system 12 to the spray bar 88 having a plurality of distributor outlets 48. An actuator can be operably coupled to the flow control assembly 138 such that pressing the actuator 44 will open the flow control assembly 138. The flow control assembly 138 can be mechanically actuated, such as by providing a push rod with one end coupled to the actuator 44 and another end in register with the flow control assembly 138, such that pressing the actuator 44 forces the push rod to open the flow control assembly 138. Alternatively, the flow control assembly 138 can be electrically actuated, such as by providing an electrical switch between the flow control assembly 138 the power source 22 that is selectively closed when the actuator 44 is actuated, thereby powering the valve to move to an open position.

In the illustrated example, an actuator is provided in the form of a trigger 126 proximate an upper portion of the handle 66, including by way of non limiting example on an underside of the handgrip 68. The trigger 126 is operably coupled with a multi-segment push rod housed within the set of sections forming the stem 98. More specifically, the trigger 126 is operably coupled to an upper push rod 130 that is primarily positioned within a hollow interior of the upper section 110, a lower push rod 134 that is primarily positioned within a hollow interior of the intermediate section 112, and a flow control assembly 138 that is primarily positioned within the lower section 114. The upper push rod 130 has an upper end 128 that is slidably mounted within the handgrip 68 and a lower end 132 that selectively operably engages the lower push rod 134. It will be understood that the upper push rod 130 aligns and transfers linear force to the lower push rod 134 when the trigger 126 is moved. The lower push rod 134 has a lower end 136 that selectively engages a flow control assembly 138 that is operably connected to a portion of the fluid delivery system 12 proximate the container receiver 124. The flow control assembly 138 may include a valve 140 that selectively allows fluid coupling between the fluid container 34, when received in the container receiver 124, and a conduit of the fluid delivery system 142, which has only partially been illustrated for clarity but which fluidly couples to the spray bar 88 having a plurality of distributor outlets 48.

During operation, the trigger 126 is positioned to engage the upper end 128 of the upper push rod 130 when squeezed by a user, forcing the upper push rod 130 to slide downwardly within the upper section 110. The lower end 132 of the upper push rod 130 engages the lower push rod 134 either directly or through a bushing seal. In turn, the lower push rod 134 slides downwardly within the intermediate section 112, and the lower end 136 engages the flow control assembly 138.

It will be understood that any suitable flow control assembly and valve can be utilized including that of a microswitch and solenoid valve positioned in the fluid flow path upstream from the distributor outlets 48 to selectively control the flow of fluid thereto. In such an instance, when the user depresses the trigger 126 the upper push rod 130 and lower push rod 134 slide downwardly and engages the microswitch (not shown), which, in turn, actuates the solenoid valve to permit cleaning fluid to flow therethrough. It should be noted that the distributor outlets 48 are normally closed.

FIG. 10 is a rear perspective view of the extraction cleaner 10 with a partially exploded recovery container 20. The recovery container 20 can include a recovery tank 150 defining a recovery chamber and an air/liquid separator assembly 152 within the recovery chamber. At least a portion of the recovery tank 150 can be formed of a transparent or tinted translucent material, which permits a user to view the contents of the recovery tank. A handle 154 can be provided on the recovery tank 150, which facilitates removing and carrying the recovery tank 150. The handle 154 can be provided near the top of the recovery tank 150, although other locations are possible.

The recovery tank 150 has an opening through which the air/liquid separator assembly 152 is inserted into and removed from the recovery chamber. The opening can be provided on a bottom wall of the recovery tank 150, such that the air/liquid separator assembly 152 is inserted through the opening and extends upwardly from the bottom wall. The recovery tank 150 can be provided with a separate opening for emptying the recovery tank 150, so that the air/liquid separator assembly 152 does not have to be removed every time the recovery tank 150 is emptied. The opening in the illustrated embodiment is provided on an upper portion of the recovery tank 150 and is covered by a removable cover 156.

The air/liquid separator assembly 152 is configured to be easily removable from the recovery tank 150 by a user. This permits the air/liquid separator assembly 152 to be disassembled and cleaned more thoroughly as needed. A coupling between the recovery tank 150 and the air/liquid separator assembly 152 can be provided for facilitating easy separation of the two components. As shown herein, the coupling comprises a threaded collar 158, which screws onto a threaded neck on the bottom wall of the recovery tank 150 which defines the opening through which the air/liquid separator assembly 152 is inserted. A flange on the bottom of the air/liquid separator assembly 152 limits insertion of the air/liquid separator assembly 152 into the recovery tank 150. A seal can provide a fluid-tight interface between the recovery tank 150 and the and the air/liquid separator assembly 152 when the air/liquid separator assembly 152 is mounted within the recovery chamber, and also prevents the recovery tank 150 from leaking when removed from the upright assembly 60.

The air/liquid separator assembly 152 includes a stack 160 for guiding air and liquid through the recovery tank 150 and a float assembly 162 for selectively closing the suction path through the recovery tank 150. The stack 160 includes an inlet column 164 which receives recovered air and liquid form the suction nozzle 16, and opens into the interior of the recovery tank 150, and an outlet column 166, which passes substantially clean air, and substantially no liquid, to the motor/fan assembly 18 (FIG. 6A) and includes an air inlet port at an upper end of the outlet column 166.

The functionality and operation of the extraction cleaner 10 is similar to that as described in U.S. Patent Application Publication No. US2019/0142238, which is incorporated herein in its entirety. Some structures are also similar including for example the float assembly 162. The current extraction cleaner is simpler in design and differences in structure include among other things, that the recovery tank 150 is located on the base assembly 62, the inclusion of the multi-segment upright assembly and structure including the push rod and the pedal assembly 200. As illustrated the upright handle stem 98 and clean tank receiver 124 nests into the back of the recovery tank 150 and allows for a more compact appearance.

Figure 11:
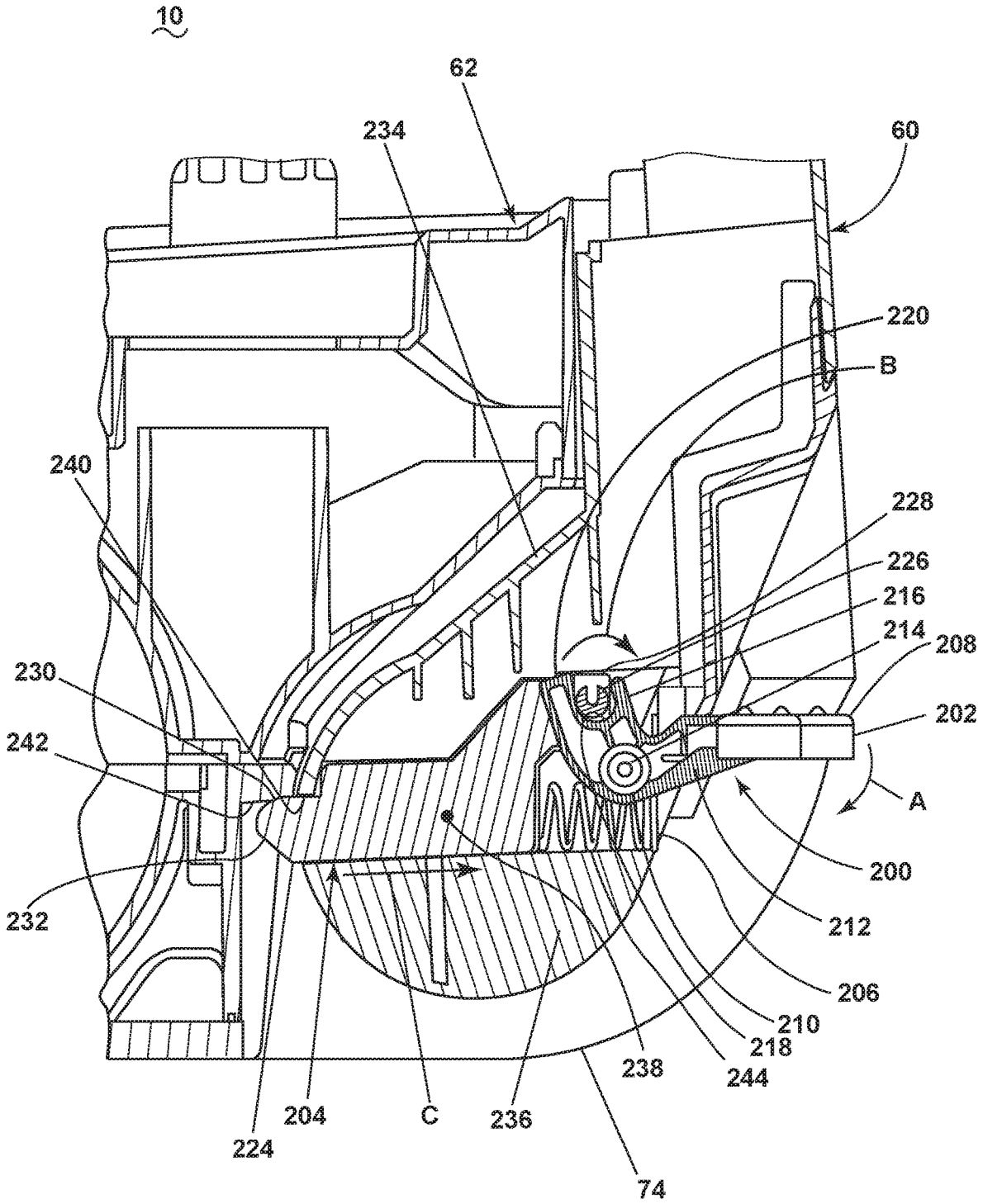
FIG. 11 is a cross-section view of a portion of the extraction cleaner of FIG. 2 illustrating a pedal assembly in a locked position.
Figure 13:
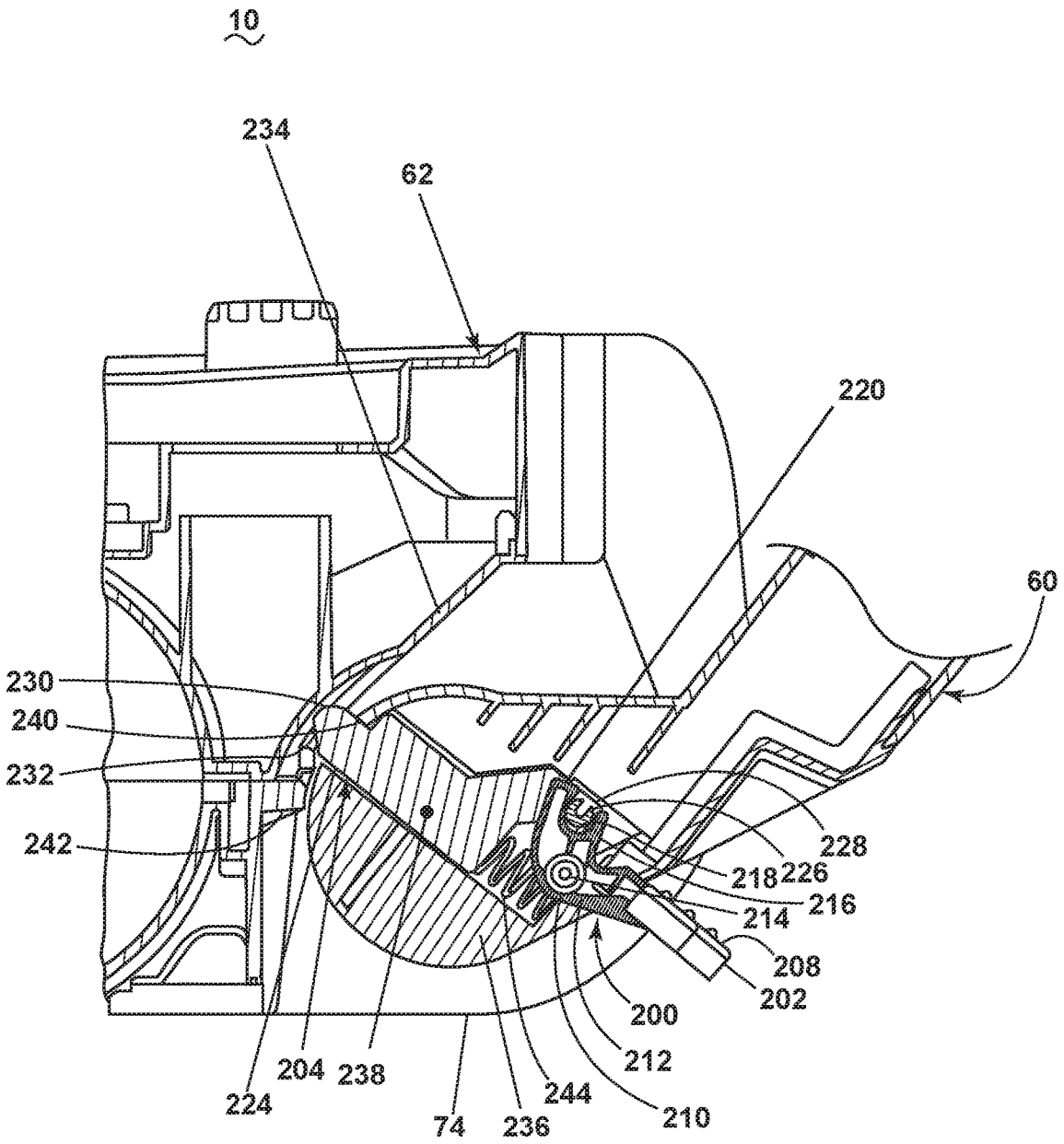
FIG. 13 is a cross-section view similar to that of FIG. 12, illustrating the upright assembly pivoted with respect to the base assembly.

FIG. 11 is a cross-sectional view of a portion of the extraction cleaner 10 including a lower portion of the upright assembly 60, a rearward portion of the base assembly 62, and a pedal assembly 200. As briefly described above, the upright assembly 60 can be pivotally coupled to the base assembly 62 and the upright assembly can transition from an upright position or storage position as shown in FIG. 11 to a reclined position or in-use position as shown in FIG. 13. A pivoting pedal 202, a sliding latch 204, and a biasing mechanism 206 are included in the pedal assembly 200, which is disposed in the rear of the upright assembly 60.

The pivoting pedal 202 includes an actuating surface 208 connected to an axle 210 by a first arm member 212. The actuating surface 208 is configured to be depressed by a user's foot. The axle 210 is pivotally mounted to a lower portion of the upright assembly 60 with the centerline of the axle 210 defining a pivot axis 214. A second arm member 216 extends away from the axle 210 and includes a catch 218 at a distal end 220 that is spaced from the axle 210. The first arm member 212 extends between the actuating surface 208 and the axle 210 such that the actuating surface 208 is disposed above and behind the axle 210. The second arm member 216 and the first arm member 212 can be defined by a unitary piece or can be operably coupled together in any suitable manner. The second arm member 216 extends upwardly and forwardly from the axle 210. The second arm member 216 and the first arm member 212 may form an L-shape or V-shape configuration. The catch 218 is formed by a channel or recess located on the distal end 220.

A sliding body 224 having a protrusion 226 located at a first end 228 of the sliding body 224 and a detent 230 located at a second end 232 are included in the sliding latch 204. The first end 228 is spaced from the second end 232. A housing for the sliding body 224 can at least partially be defined by an upper section 234 and a lower section 236, both of which are included in the upright assembly 60 and pivotal therewith about pivot axis 238. More specifically, lower section 234 and upper section 236 are areas within or portions of the lower section 114 of the handle assembly 60. An opening 240 is formed at a forward portion between the upper section 234 and the lower section 236. The sliding body is moveable between a first position or locked position and a second position or released position. In the locked position (FIG. 11) the detent 230 extends through the opening 240 and engages a portion or lip 242 of the base housing 74 preventing pivotal motion of the upright assembly 60 until released. In the released position (FIG. 12) the detent 230 is withdrawn through the opening 240 and out of engagement with the lip 242 formed in the base housing 74.

The biasing mechanism 206 is illustrated herein as a coil spring mounted within the base assembly 62. More specifically the coil spring 244 can be mounted between the first end 228 of the sliding body 224 and the lower section 236. It is contemplated that the coil spring 244 can be located in an enclosed spring mounting pocket within the lower section 236. It will be understood that any suitable biasing mechanism can be used, and a coil spring has been illustrated for exemplary purposes only. It will be understood that the biasing mechanism may have spring forces that are optimized to overcome all resistive forces such as friction, weight and spring tension in order to provide for movement of the sliding body 224.

Further, while not illustrated it is contemplated that a second biasing mechanism can be utilized to bias the pivoting pedal 202 upwards. Further still, the pedal assembly 200 may further include a detent mechanism for selectively securing the pivoting pedal 202 in the down position.

Figure 12:
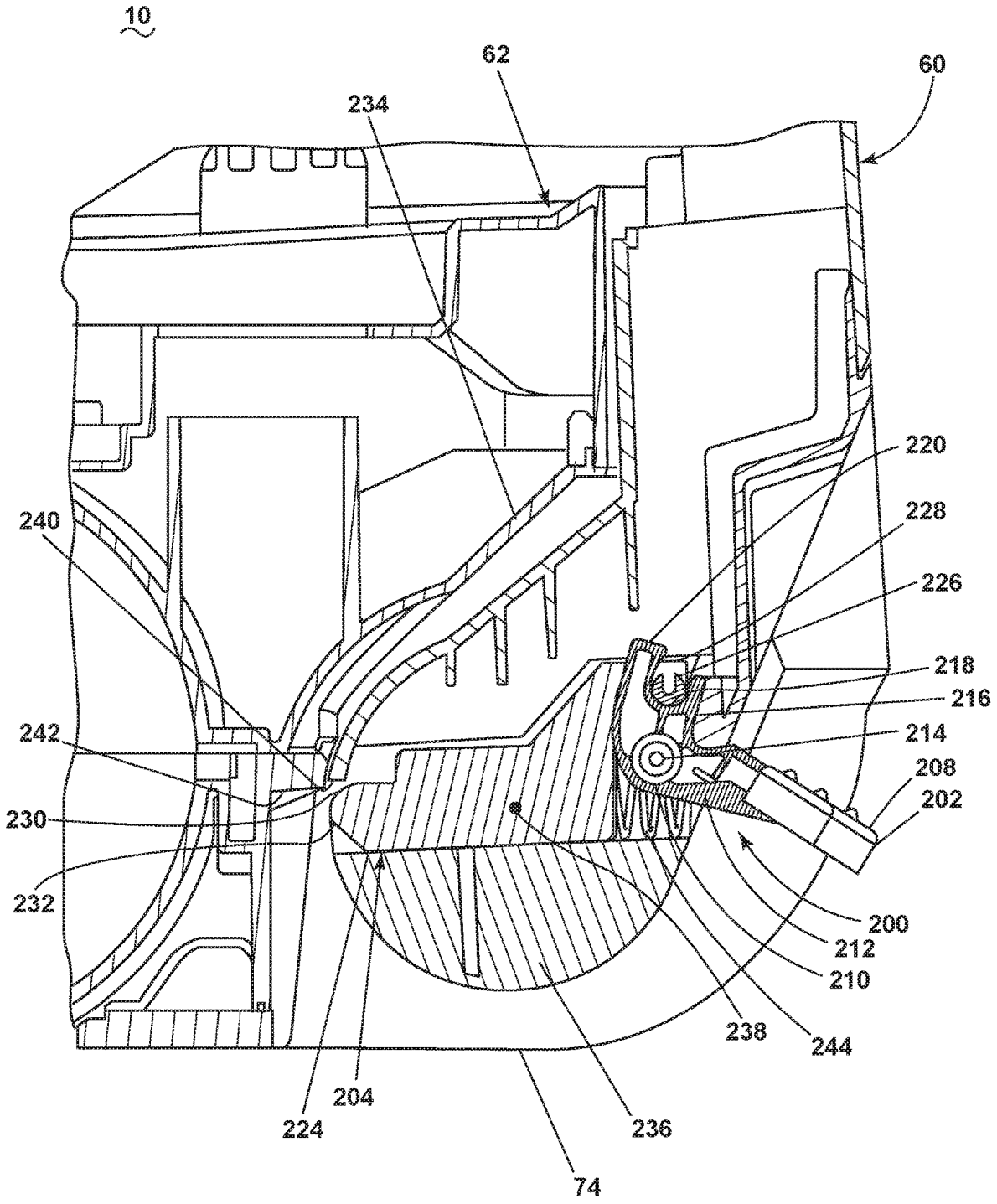
FIG. 12 is a cross-section view similar to that of FIG. 11, illustrating a pedal assembly in a released position.

During operation, the actuating surface of the pivoting pedal 202 is configured to selectively rotate downward in a direction indicated by arrow A when depressed by a user. The first arm member 212 and the second arm member 216 rotate about the pivot axis 214 and cause the catch 218 with the protrusion 226 retained therein to move in a rearward and downward direction as illustrated by arrow B. This moves the sliding body from the locked position (FIG. 11) to the disengaged position or released position (FIG. 12). A user can then pivot the upright assembly 60 with respect to the base assembly 62 as illustrated in FIG. 13.

When the pivoting pedal 202 is released and the upright assembly 60 is returned to the upright position or storage position, the biasing mechanism 206 provides a spring force on the sliding body 224 and moves the detent 230 into engagement with the lip 242 of the base housing 74. It is contemplated that detent 230 may have a ramped or curved surface to facilitate the movement of the detent 230 under the lip 242.

While the various embodiments illustrated herein show an upright extraction cleaner, for example FIG. 2, aspects of the invention may be used on other types of extraction cleaners, including, but not limited to, a canister device having a cleaning implement connected to a wheeled base by a vacuum hose, a portable extractor adapted to be hand carried by a user for cleaning relatively small areas, or a commercial extractor. Still further, aspects of the invention may also be used on surface cleaning apparatus other than extraction cleaners, such as a vacuum cleaner or steam cleaner. A vacuum cleaner typically does not deliver or extract liquid, but rather is used for collecting relatively dry debris, which may include dirt, dust, stains, soil, hair, and other debris from a surface. A steam cleaner generates steam for delivery to the surface to be cleaned, either directly or via cleaning pad. Some steam cleaners collect liquid in the pad, or may extract liquid using suction force.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects of the disclosure are provided by the subject matter of the following clauses:

A surface cleaning apparatus including a housing including an upright assembly and a base assembly moveably mounted to the upright assembly, the upright assembly comprising at least one of: an inverted T-shape or a set of sections selectively coupled together to form a stalk, a fluid container provided on the housing, a fluid distributor provided in the base assembly in fluid communication with the fluid container, a working air path through the housing, a recovery container provided on the housing and defining a portion of the working air path, a suction source provided on the housing and defining a portion of the working air path, and a suction nozzle provided on the base assembly.

The surface cleaning apparatus according to any preceding clause wherein the set of sections comprise an upper section having a handgrip, an intermediate section, and a lower section having a set of wheels.

The surface cleaning apparatus according to any preceding clause wherein one of the upper section and the intermediate section includes a flexible latch and an other of the upper section and the intermediate section includes a receiver adapted to receive the flexible latch.

The surface cleaning apparatus according to any preceding clause wherein the flexible latch includes a catch having a first profile and the receiver includes a recess or opening having a complementary profile adapted to receive the catch therein.

The surface cleaning apparatus according to any preceding clause wherein the flexible latch is operably coupled to a button and force provided by a user on the button moves the flexible latch out of engagement with the receiver.

The surface cleaning apparatus according to any preceding clause wherein the set of sections snap together without tools or fasteners.

The surface cleaning apparatus according to any preceding clause, further comprising a valve fluidly connected between the fluid container and the fluid distributor, the valve operable between a closed position and an opened position for providing fluid from the fluid container to the fluid distributor and an actuator for selectively opening the valve.

The surface cleaning apparatus according to any preceding clause wherein the actuator comprises a push rod configured to selectively open the valve and a user-engageable trigger operably connected to the push rod.

The surface cleaning apparatus according to any preceding clause wherein the push rod is a multi-segment push rod.

The surface cleaning apparatus according to any preceding clause wherein the user-engageable trigger is located on the upper section and the fluid distributor is located within the lower section.

The surface cleaning apparatus according to any preceding clause wherein the suction nozzle is selectively mounted on the base assembly via at least one latch that prevents the suction nozzle from accidentally releasing from the base assembly but allows for removal without tools.

The surface cleaning apparatus according to any preceding clause wherein the at least one latch is a snap-fit latch.

The surface cleaning apparatus according to any preceding clause, further comprising a pedal assembly provided in the housing and configured to selectively allow pivotal motion of the upright assembly with respect to the base assembly until released.

The surface cleaning apparatus of any preceding clause wherein the pedal assembly includes a pivoting pedal extending from a rear of the upright assembly, a sliding latch operably coupled to the pivoting pedal and moveable between a locked position, and a released position and a biasing mechanism configured to bias the sliding latch into the latched position.

The surface cleaning apparatus of any preceding clause wherein the pivoting pedal further comprises an actuating surface coupled to an axle via a first arm member and a second arm member extending away from the axle, the second arm member including a portion that is operably coupled to the sliding latch.

A surface cleaning apparatus, including a housing including an upright assembly forming a stalk and a base mounted to the upright assembly and adapted for movement across a surface to be cleaned, a working air path through the housing, a recovery container provided on the housing and defining a portion of the working air path, a suction source provided on the housing and defining a portion of the working air path and a pedal assembly provided in the housing and configured to selectively allow pivotal motion of the upright assembly with respect to the base until released, the pedal assembly including a pivoting pedal extending from a rear of the base assembly, the pivoting pedal including an actuating surface coupled to an axle via a first arm member and a second arm member extending away from the axle, the second arm member including a portion that is operably coupled to the sliding latch, the axle rotatably mounted to a portion of the upright assembly, a sliding latch operably coupled to the pivoting pedal and moveable between a locked position wherein a portion of the sliding latch engages the base and a released position, and a biasing mechanism configured to bias the sliding latch into the latched position.

The surface cleaning apparatus according to any preceding clause wherein the second arm member further comprises a catch at a distal end spaced from the axle, the catch configured to retain a portion of the sliding latch.

The surface cleaning apparatus according to any preceding clause wherein the sliding body further comprises a protrusion located at a first end, the protrusion retained by the catch of the second arm member, and a detent located at a second end, the detent configured to engage a portion of the base in the locked position.

The surface cleaning apparatus according to any preceding clause further comprising a fluid delivery system for storing cleaning fluid and delivering the cleaning fluid to the surface to be cleaned, including a fluid container, a fluid distributor provided in the base in fluid communication with the fluid container, a flow control assembly fluidly connected between the fluid container and the fluid distributor, the flow control assembly operable between a closed position and an opened position for providing fluid from the fluid container to the fluid distributor, and an actuator for selectively opening the flow control assembly.

The surface cleaning apparatus according to any preceding clause wherein the actuator comprises a multi-segment push rod configured to selectively open the valve and a user-engageable trigger operably connected to the push rod.

The disclosed embodiments are representative of preferred forms of the invention and are intended to be illustrative rather than definitive of the invention. To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described.

What is claimed is:

1. A surface cleaning apparatus, comprising:

a housing including an upright assembly and a base assembly moveably mounted to the upright assembly, the upright assembly comprising a set of sections selectively coupled together to form a stalk having a forwardly-extending arm at a lower extent of the stalk and a rearwardly-extending arm at the lower extent of the stalk;

a fluid container provided on the housing;

a fluid distributor provided in the base assembly in fluid communication with the fluid container;

a working air path through the housing;

a recovery container provided on the housing and defining a portion of the working air path;

a suction source provided on the housing and defining a portion of the working air path; and a suction nozzle provided on the base assembly;

a valve fluidly connected between the fluid container and the fluid distributor, the valve operable between a closed position and an opened position for providing fluid from the fluid container to the fluid distributor; and an actuator for selectively opening the valve;

wherein the set of sections comprise an upper section having a handgrip, an intermediate section couplable to the upper section, and a lower section couplable to the intermediate section and having the valve and a set of wheels;

wherein one of the upper section and the intermediate section includes a flexible latch and the other of the upper section and the intermediate section includes a receiver adapted to receive the flexible latch to releasably couple the upper section to the intermediate section;

wherein the actuator comprises a push rod configured to selectively open the valve and a user-engageable trigger operably connected to the push rod;

wherein the push rod is a multi-segment push rod including an upper push rod positioned within the upper section and a lower push rod positioned within the intermediate section even when the upper section is not coupled with the intermediate section;

wherein the upper push rod selectively engages the lower push rod when the upper section is coupled with the intermediate section via the receiver and the flexible latch, the upper push rod remaining within the upper section and the lower push rod remaining within the intermediate section; and wherein the valve is positioned in the lower section and the lower push rod selectively engages the valve when the intermediate section is coupled with the lower section and the user-engageable trigger is moved.

2. The surface cleaning apparatus of claim 1 wherein the flexible latch includes a catch having a first profile and the receiver includes a recess or opening having a complementary profile adapted to receive the catch therein.

3. The surface cleaning apparatus of claim 1 wherein the flexible latch is operably coupled to a button and force provided by a user on the button moves the flexible latch out of engagement with the receiver.

4. The surface cleaning apparatus of claim 1 wherein the set of sections snap together without tools or fasteners.

5. The surface cleaning apparatus of claim 1 wherein the user-engageable trigger is located on the upper section and the fluid distributor is located within the lower section.

6. The surface cleaning apparatus of claim 1 wherein the suction nozzle is selectively mounted on the base assembly via at least one latch that prevents the suction nozzle from accidentally releasing from the base assembly and allows for removal without tools.

7. The surface cleaning apparatus of claim 6 wherein the at least one latch is a snap-fit latch.

8. The surface cleaning apparatus of claim 1, further comprising a pedal assembly provided in the housing and configured to selectively allow pivotal motion of the upright assembly with respect to the base assembly until released.

9. The surface cleaning apparatus of claim 8 wherein the pedal assembly includes the rearwardly-extending arm configured as a pivoting pedal extending from a rear of the base assembly, a sliding latch operably coupled to the pivoting pedal and moveable between a locked position and a released position, and a biasing mechanism configured to bias the sliding latch into the locked position.

10. The surface cleaning apparatus of claim 9 wherein the pivoting pedal further comprises an actuating surface coupled to an axle via a first arm member and a second arm member extending away from the axle, the second arm member including a portion that is operably coupled to the sliding latch.

11. A surface cleaning apparatus, comprising:

a housing including an upright assembly forming a stalk having a stem, and the housing further including a base mounted to the upright assembly and adapted for movement across a surface to be cleaned;

the upright assembly comprising a set of sections selectively coupled together to form the stalk, the set of sections including at least an upper section, a lower section, and an intermediate section releasably coupled at a top end to the upper section via a receiver and a latch and at a bottom end to the lower section via another receiver and another latch;

a working air path through the housing;

a recovery container provided on the housing and defining a portion of the working air path;

a suction source provided on the housing and defining a portion of the working air path; and a pedal assembly provided in the housing and configured to selectively allow pivotal motion of the upright assembly with respect to the base about a pivot axis extending transversely through the base until released, the housing having a rear rearward of the pivot axis and a front forward of the pivot axis, the pedal assembly comprising:

a pivoting pedal extending from the rear of the housing and rearward of the stem, the pivoting pedal including an actuating surface coupled to an axle via a first arm member and a second arm member extending away from the axle, the axle rotatably mounted to a portion of the upright assembly;

a sliding latch operably coupled to the second arm member of the pivoting pedal and moveable between a locked position wherein a portion of the sliding latch engages the base and a released position; and a biasing mechanism configured to bias the sliding latch into the locked position;

a fluid delivery system for storing cleaning fluid and delivering the cleaning fluid to the surface to be cleaned, comprising:

a fluid container;

a fluid distributor provided in the base in fluid communication with the fluid container;

a flow control assembly fluidly connected between the fluid container and the fluid distributor, the flow control assembly operable between a closed position and an opened position for providing fluid from the fluid container to the fluid distributor; and an actuator for selectively opening the flow control assembly;

wherein the actuator comprises a multi-segment push rod configured to selectively open the flow control assembly and a user-engageable trigger operably connected to the multi-segment push rod;

wherein the multi-segment push rod includes an upper push rod positioned within the upper section and a lower push rod positioned within the intermediate section even when the upper section is not coupled with the intermediate section;

wherein the upper push rod selectively engages the lower push rod when the upper section is coupled with the intermediate section via the receiver and the latch, the upper push rod remaining within the upper section and the lower push rod remaining within the intermediate section; and wherein the flow control assembly is positioned in the lower section and the lower push rod selectively engages the flow control assembly when the intermediate section is coupled with the lower section and the user-engageable trigger is moved.

12. The surface cleaning apparatus of claim 11 wherein the second arm member further comprises a catch at a distal end spaced from the axle, the catch configured to retain a portion of the sliding latch.

13. The surface cleaning apparatus of claim 12 wherein the sliding latch further comprises a protrusion located at a first end, the protrusion retained by the catch of the second arm member, and a detent located at a second end, the detent configured to engage a portion of the base in the locked position.

14. A surface cleaning apparatus, comprising:

a housing including an upright assembly and a base assembly moveably mounted to the upright assembly, the upright assembly comprising a set of sections selectively coupled together to form a stalk; the set of sections including at least an upper section, a lower section, and an intermediate section releasably coupled at a top end to the upper section via a receiver and a latch and at a bottom end to the lower section via another receiver and another latch;

a fluid container provided on the housing;

a fluid distributor located within the lower section and in fluid communication with the fluid container;

a valve located in the lower section and fluidly connected between the fluid container and the fluid distributor, the valve operable between a closed position and an opened position, the valve providing fluid from the fluid container to the fluid distributor when in the opened position;

a multi-segment push rod actuatable to selectively open the valve; the multi-segment push rod including an upper push rod positioned within the upper section and a lower push rod positioned within the intermediate section; and a user-engageable trigger located on the upper section and operably connected to the upper push rod, a lower end of the upper push rod releasably operatively engaging the lower push rod when the user-engageable trigger is moved such that a lower end of the lower push rod engages the valve;

wherein the upper push rod disengages from the lower push rod when the upper section is released from the intermediate section via the receiver and the latch, the upper push rod remaining within the upper section and the lower push rod remaining within the intermediate section.

* * * * *